US011241096B2

(12) United States Patent
Sun

(10) Patent No.: US 11,241,096 B2
(45) Date of Patent: Feb. 8, 2022

(54) CROSSWISE-FOLDING ROCKING CHAIR

(71) Applicant: Benlong Sun, Jinhua (CN)

(72) Inventor: Benlong Sun, Jinhua (CN)

(73) Assignee: ZHEJIANG PRIDE LEISURE PRODUCTS CO., LTD., Zhejiang Province (CN)

( * ) Notice: Subject to any disclaimer, the term of this patent is extended or adjusted under 35 U.S.C. 154(b) by 0 days.

(21) Appl. No.: 17/086,524

(22) Filed: Nov. 2, 2020

(65) Prior Publication Data

US 2021/0204697 A1 Jul. 8, 2021

(30) Foreign Application Priority Data

Jan. 8, 2020 (CN) ..... 202020034283.2

(51) Int. Cl.

| | |
|---|---|
| ***A47C 4/28*** | (2006.01) |
| ***A47C 4/30*** | (2006.01) |
| ***A47C 3/029*** | (2006.01) |
| ***A47C 7/40*** | (2006.01) |

(52) U.S. Cl.

CPC ..... *A47C 4/283* (2013.01); *A47C 3/029* (2013.01); *A47C 4/30* (2013.01); *A47C 7/407* (2013.01)

(58) Field of Classification Search

CPC ..... A47C 3/029; A47C 4/28; A47C 4/283; A47C 4/34; A47C 4/38; A47C 4/44; A47C 4/48; A47C 4/045; A47C 7/407; A47C 7/543

USPC ... 297/35, 36, 42, 44, 45, 51, 53, 56, 271.6, 297/272.4, 378.1

See application file for complete search history.

(56) References Cited

U.S. PATENT DOCUMENTS

| | | | | | |
|---|---|---|---|---|---|
| 1,435,432 | A * | 11/1922 | Toth | A47C 3/029 | 297/272.3 |
| 2,054,487 | A * | 9/1936 | Simpson | A47C 3/029 | 297/272.2 |
| 3,071,409 | A * | 1/1963 | Gibson | A47C 4/283 | 297/45 |
| 5,507,548 | A * | 4/1996 | Marhefka | A47C 4/283 | 297/45 |
| 2010/0013273 | A1* | 1/2010 | Chen | A47C 4/283 | 297/42 |
| 2010/0171342 | A1* | 7/2010 | Chen | A47C 4/283 | 297/45 |
| 2011/0169304 | A1* | 7/2011 | Chen | A47C 4/283 | 297/35 |
| 2015/0282624 | A1* | 10/2015 | Baoqing | A47C 4/283 | 297/36 |

FOREIGN PATENT DOCUMENTS

| | | | | | |
|---|---|---|---|---|---|
| CH | 389849 | A * | 3/1965 | A47C 4/283 | |
| FR | 136315 | A * | 6/1964 | A47C 4/283 | |

* cited by examiner

*Primary Examiner* — Robert Canfield

(74) *Attorney, Agent, or Firm* — WPAT Law, P.C.; Anthony King

(57) ABSTRACT

A crosswise-folding rocking chair having a chair frame and a chair cloth, wherein the chair frame includes two back tubes, two turnover bases, two armrest tubes, four armrest limit sleeves, four bushings, four step rivets, and two base frames, Each base frame is formed by a bent steel tube having a necked end, and the necked end is inserted into a non-necked end to form a closed polygonal frame. The two base frames are riveted together in an X shape, and the polygonal frames have lower arc segments and upper joint segments.

12 Claims, 21 Drawing Sheets

CROSSWISE-FOLDING ROCKING CHAIR

BACKGROUND OF THE INVENTION

1. Technical Field

The utility model relates to the technical field of daily goods, in particular to a crosswise-folding rocking chair.

2. Description of Related Art

Rocking chairs as furniture for people to relax in are able to rock forwards and backwards. Most existing rocking chairs adopt two symmetrical arc rockers having two arc ends tilting upwards to support the chair bottom during rocking, and a reclining cushion is arranged on the two arc rockers and has two ends fixed to the arc rockers through armrests. The arc rockers and the armrests of the whole chairs are typically assembled fixedly, and the existing rocking chairs cannot be disassembled, thus having a large size and occupying a large area. The whole rocking chairs have to be moved in use, thus being inconvenient to carry and occupying a large space when carried. Thus, the existing rocking chairs are not suitable for families, picnics, self-driving tours, outdoor recreation, and so on, and cannot meet the requirements of people for portable reclining chairs for rest and relaxation.

In view of the shortcomings of traditional rocking chairs, this utility model carries out research on fabrication technologies relating to reclining chairs to make the reclining chairs more convenient to carry.

BRIEF SUMMARY OF THE INVENTION

The objective of the utility model is to provide a crosswise-folding rocking chair to solve the problem that existing reclining chairs are large in size and inconvenient to carry.

The technical solution adopted by the utility model to fulfill the above-mentioned objective of the utility model is as follows:

A crosswise-folding rocking chair comprises a chair frame and a chair cloth arranged on the chair frame, wherein the chair frame includes two back tubes, two turnover bases, two armrest tubes, four armrest limit sleeves, four bushings, four step rivets, and two base frames, wherein the two armrest tubes are respectively welded to the two turnover bases, which are respectively riveted to the two armrest tubes and are able to axially rotate around the rivets. Each base frame is formed by a bent steel tube having a necked end, and the necked end is inserted into a non-necked end to form a closed polygonal frame. The two base frames are riveted together in an X shape, and the polygonal frames have lower arc segments and upper joint segments. Two bushings are respectively disposed around two sides of each joint segment through the necked end and the non-necked end, two armrest limit sleeves welded to one armrest tube are respectively disposed around the two bushings, two step rivets penetrate through annular limit grooves in the two armrest limit sleeves to fix the two bushings to one base frame, and the armrest limit sleeves drive the armrest tube welded to the armrest limit sleeves to rotate until the armrest tube makes contact with the rivets; and a seat cushion and a backrest of the chair cloth are respectively installed on the joint segments of the base frames and the back tubes.

Furthermore, the crosswise-folding rocking chair further comprises two wear-resistant foot casings respectively arranged on the arc segments of the two base frames.

Furthermore, the wear-resistant foot casings having openings in a length direction and are disposed around the arc segments via the openings.

Furthermore, two sides of the seat cushion of the chair cloth are respectively disposed around the joint segments of the two base frames, and the necked ends are inserted into the non-necked ends to be covered with the cloth on two sides of the seat cushion.

A crosswise-folding rocking chair of another structure comprises a chair frame and a chair cloth arranged on the chair frame, wherein the chair frame includes two back tubes, two turnover bases, two armrest tubes, four armrest fixing bases, and two base frames, wherein the two back tubes are respectively welded to the two turnover bases, which are respectively riveted to the two armrest tubes and are able to axially rotate around the rivets. Each base frame is formed by a bent steel tube having a necked end, and the necked end is inserted into a non-necked end to form a closed polygonal frame. The two base frames are riveted together in an X shape, and the polygonal frames have lower arc segments and upper joint segments. The armrest fixing bases are respectively arranged on two sides of the necked end and non-necked end of each joint segment, and the two armrest tubes are respectively riveted to the armrest fixing bases on the two joint segments; and a seat cushion and a backrest of the chair cloth are respectively installed on the joint segments of the base frames and the back tubes.

Furthermore, the crosswise-folding rocking chair further comprises two wear-resistant foot casings respectively arranged on the arc segments of the two base frames.

Furthermore, the wear-resistant foot casings having openings in a length direction and are disposed around the arc segments via the openings.

Furthermore, two sides of the seat cushion of the chair cloth are respectively disposed around the joint segments of the two base frames, and the necked ends are inserted into the non-necked ends to be covered with the cloth on two sides of the seat cushion.

Compared with the prior art, the utility model has the following beneficial effects: the rocking chair is provided with foldable armrests and a foldable back, thereby being simple in structure, comfortable, capable of rocking smoothly, and compact after being folded; and the rocking chair can rock by means of the arc segments of the base frames, and can be carried more conveniently and rapidly.

DETAILED DESCRIPTION OF THE INVENTION

Figure 1:
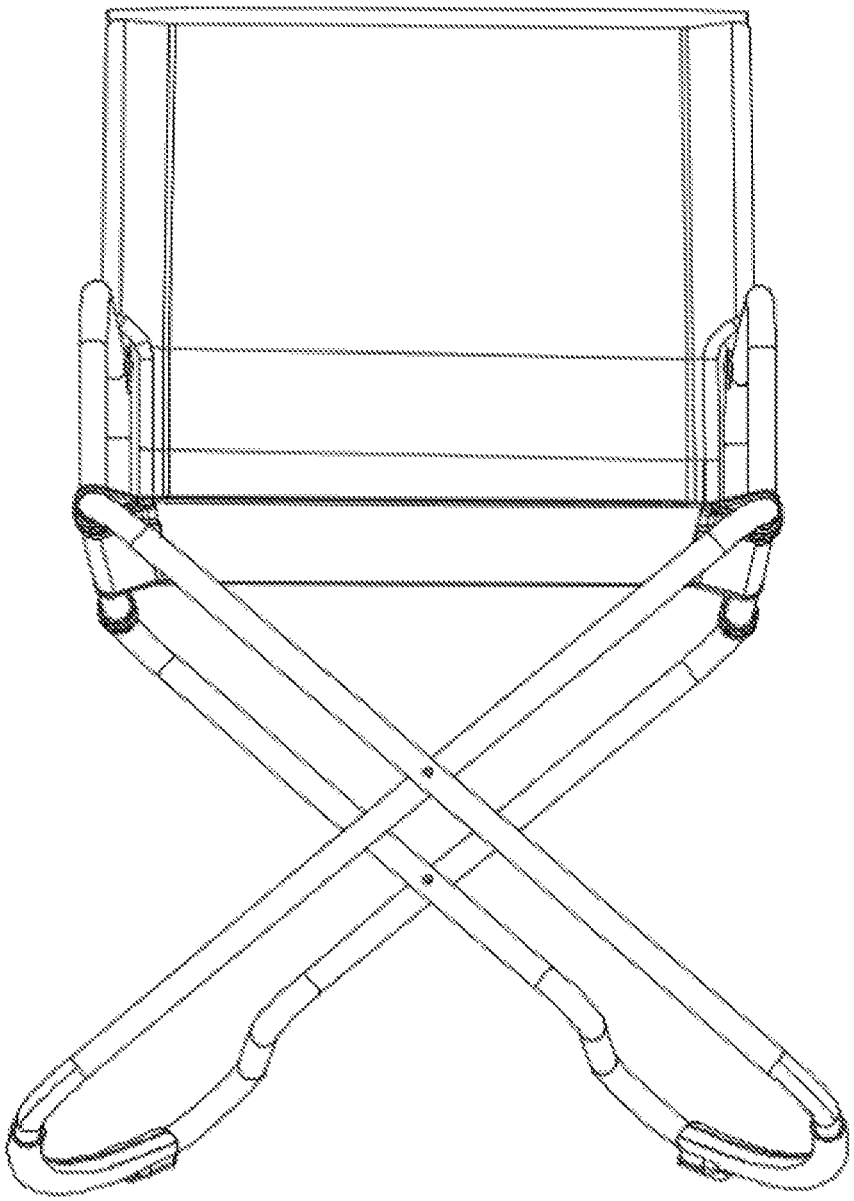
FIG. 1 is a front view of a crosswise-folding rocking chair
Figure 2:
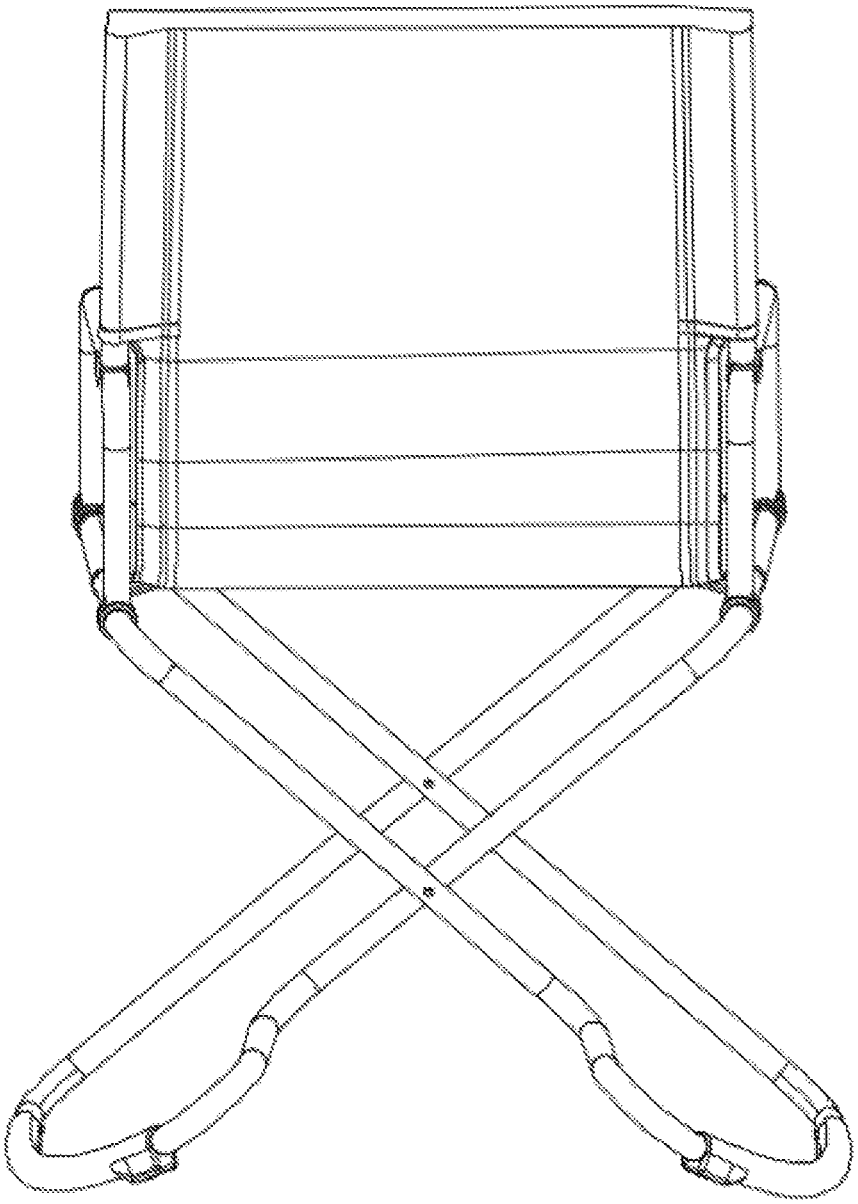
FIG. 2 is a rear view of FIG. 1
Figure 3:
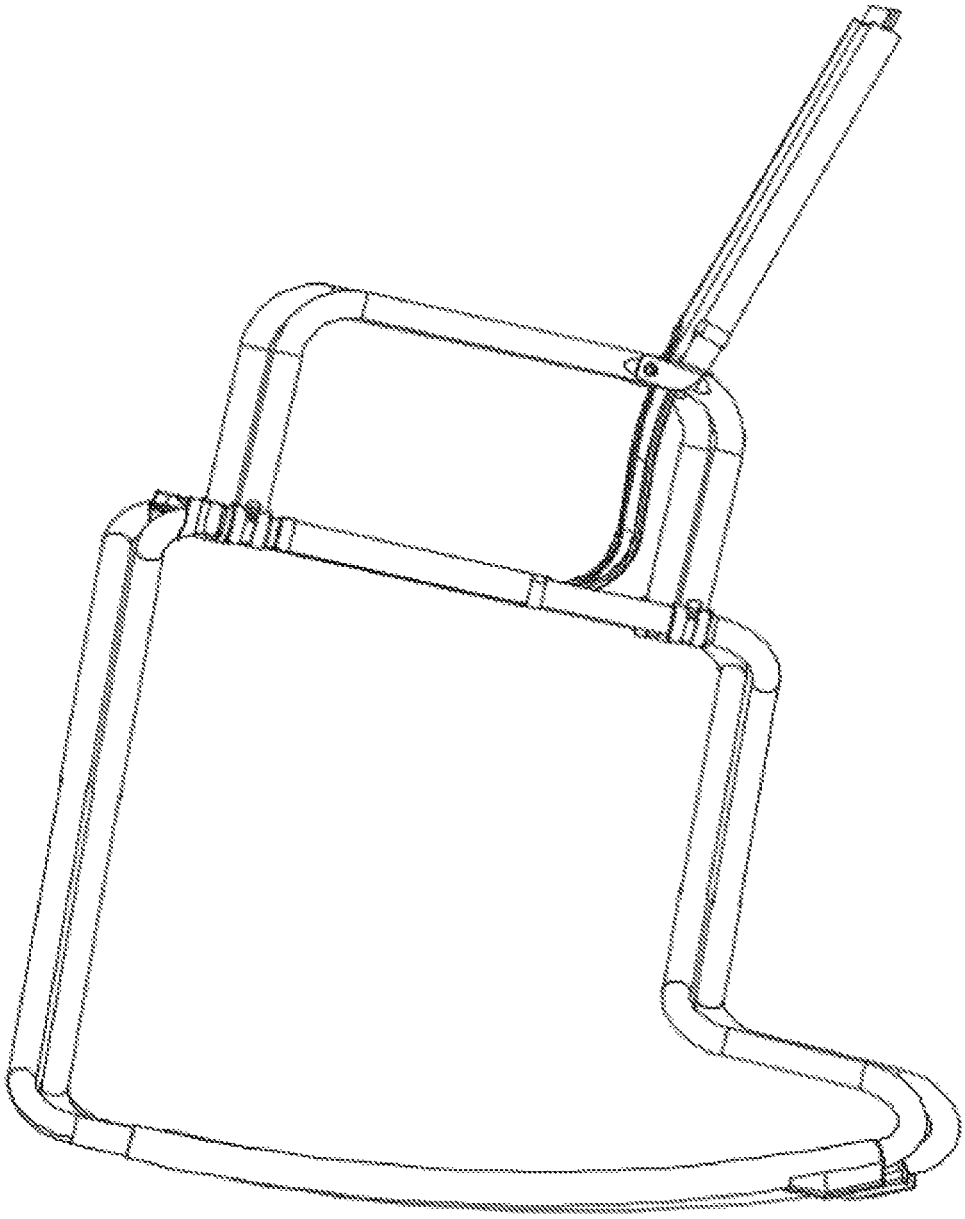
FIG. 3 is a left view of FIG. 1
Figure 4:
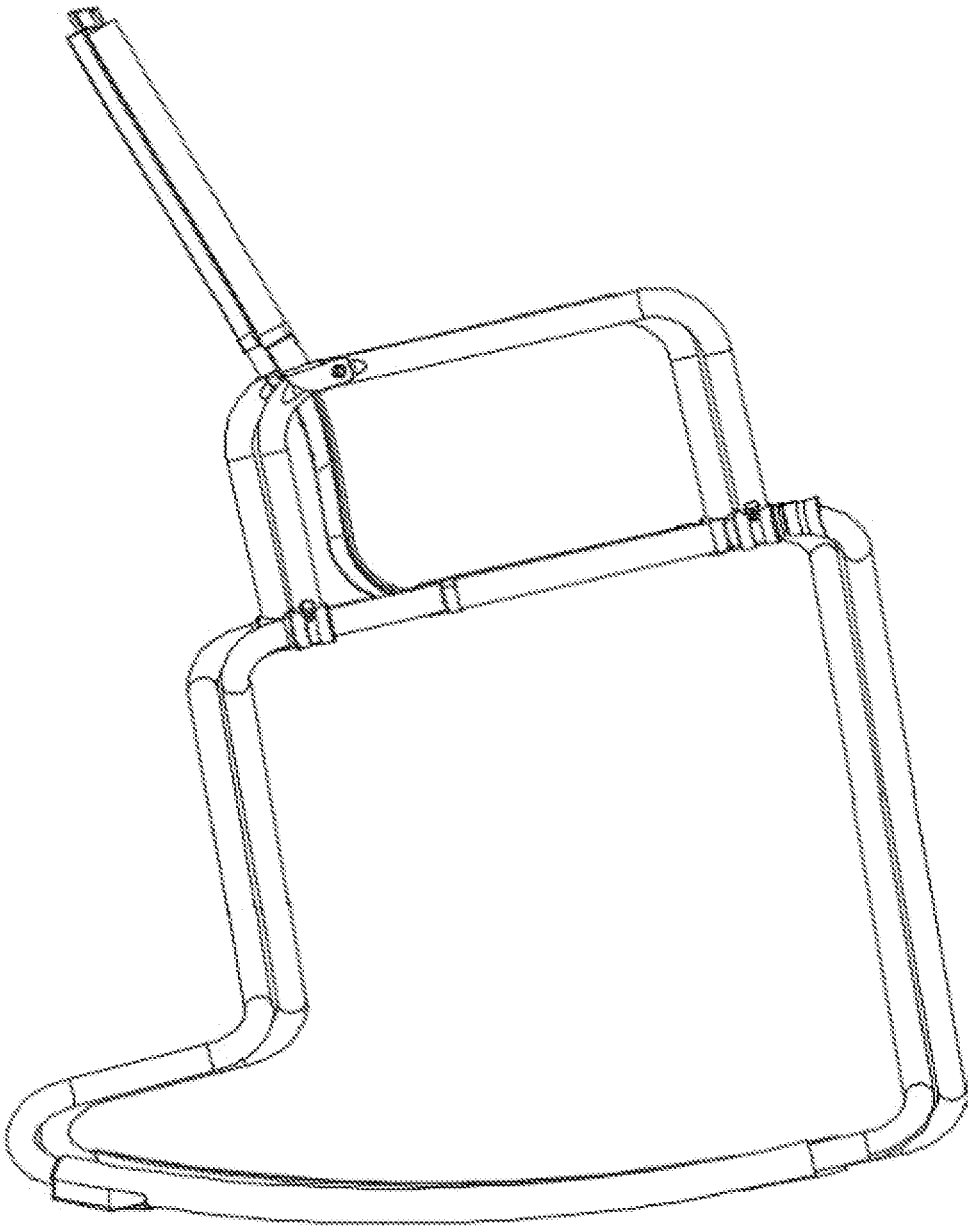
FIG. 4 is a right view of FIG. 1
Figure 5:
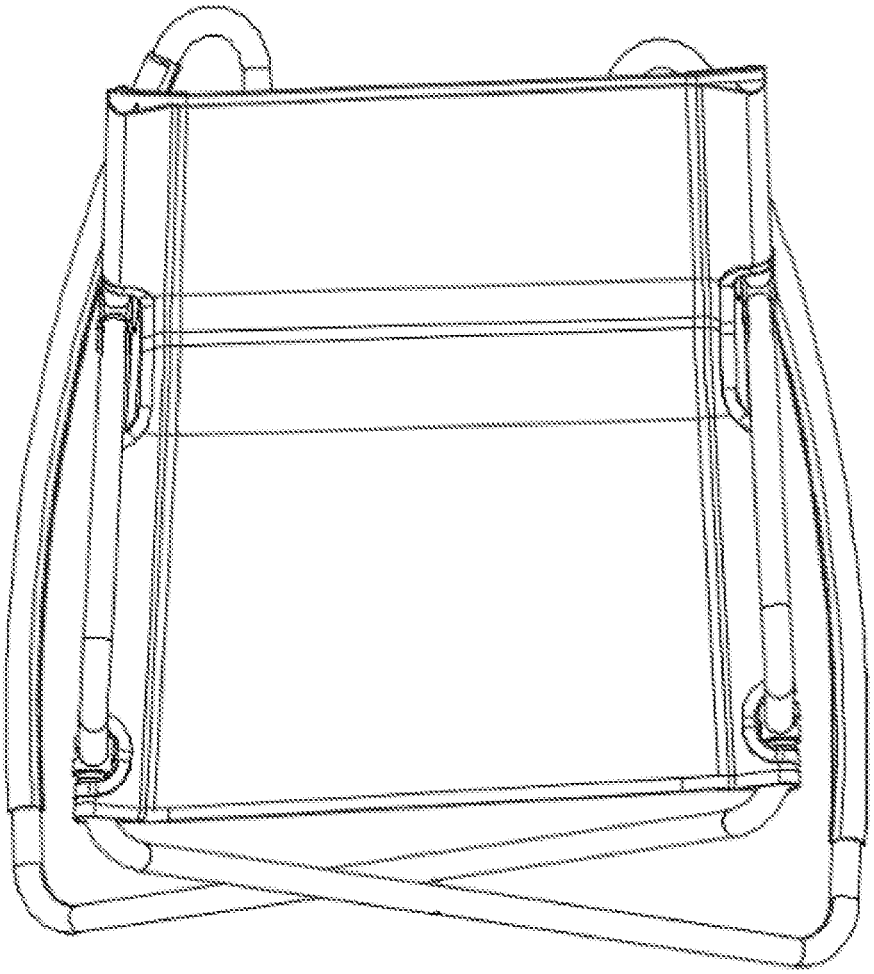
FIG. 5 is a top view of FIG. 1
Figure 6:
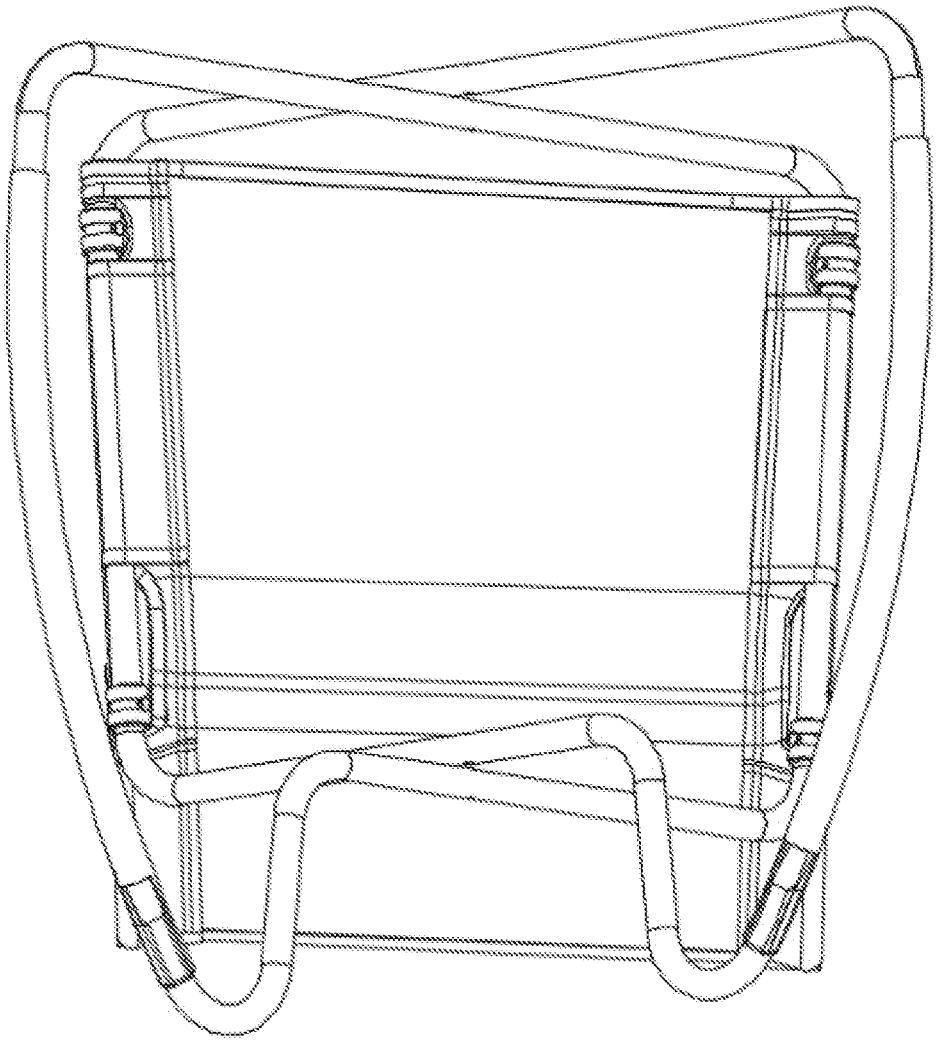
FIG. 6 is a bottom view of FIG. 1

The technical solution of the utility model is further expounded below with reference to the embodiments to be better understood. Those skilled in the art can easily appreciate other advantages and effects of the utility model on the basis of the contents in the specification, and can also implement or apply the utility model in other embodiments and make various transformations or changes on the details in the specification on the basis of different viewpoints and applications without deviating from the spirit of the utility model.

Embodiment 1

As shown in FIGS. 1-9, FIG. 11, FIGS. 13-21, this embodiment discloses a crosswise-folding rocking chair which comprises a chair cloth 1 and a chair frame 2, wherein the chair frame 2 includes two back tubes 3, two turnover bases 4, two armrest tubes 5A, four armrest limit sleeves 6A, four bushings 7, four step rivets 8, two base frames 9, and two wear-resistant foot casings 10, wherein the two back tubes 3 are respectively welded to the two turnover bases 4, which are respectively riveted to the two armrest tubes 5A and can axially rotate around the rivets. Each base frame 9 is formed by a bent steel tube having a necked end, and the necked end is inserted into a non-necked end to form a closed polygonal frame. The two base frames 9 are riveted together in an X shape, and the polygonal frames have lower arc segments and upper joint segments. Two bushings 7 are respectively disposed around two sides of each joint segment through the necked end and the non-necked end, two armrest limit sleeves welded to one armrest tube 5A are respectively disposed around the two bushings, two step rivets penetrate through annular limit grooves in the two armrest limit sleeves to fix the two bushings to one base frame, and the armrest limit sleeves drive the armrest tube welded to the armrest limit sleeves to rotate until the armrest tube makes contact with the rivets. A seat cushion and a backrest of the chair cloth are respectively installed on the joint segments of the base frames and the back tubes; and the two wear-resistant foot casings are respectively arranged on the arc segments of the two base frames.

Preferably, the wear-resistant foot casings 10 have openings in a length direction, and the arc segments are embedded into the wear-resistant foot casings 10 via the openings.

Preferably, two sides of the seat cushion of the chair cloth 1 are respectively disposed around the joint segments of the two base frames 9, and the necked ends are inserted into the non-necked ends to be covered with the cloth on two sides of the seat cushion, so that end-to-end joints of the base frames are prevented from exposure.

Figure 11:
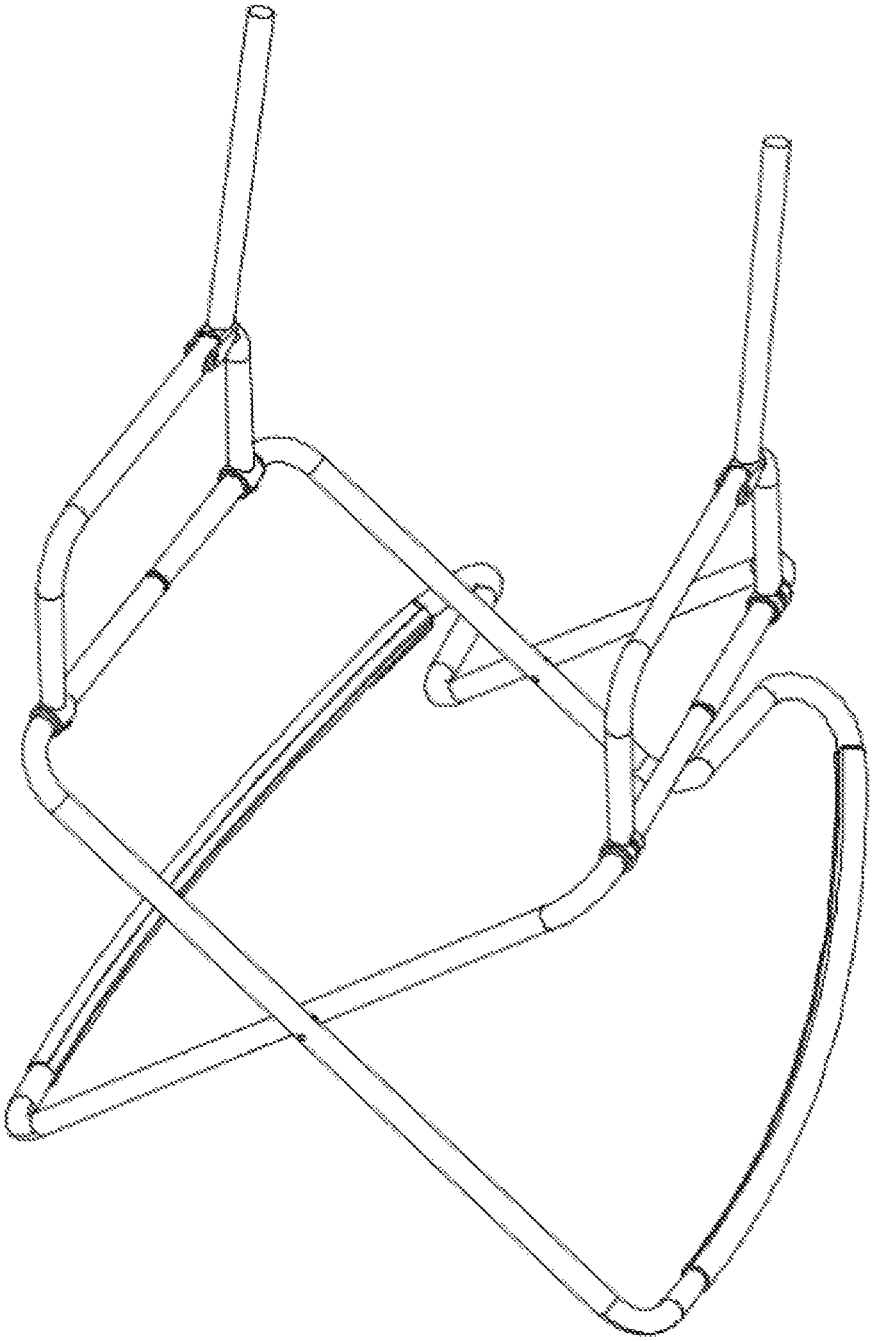
FIG. 11 is a structural view of the first chair frame in an unfolded state
Figure 13:
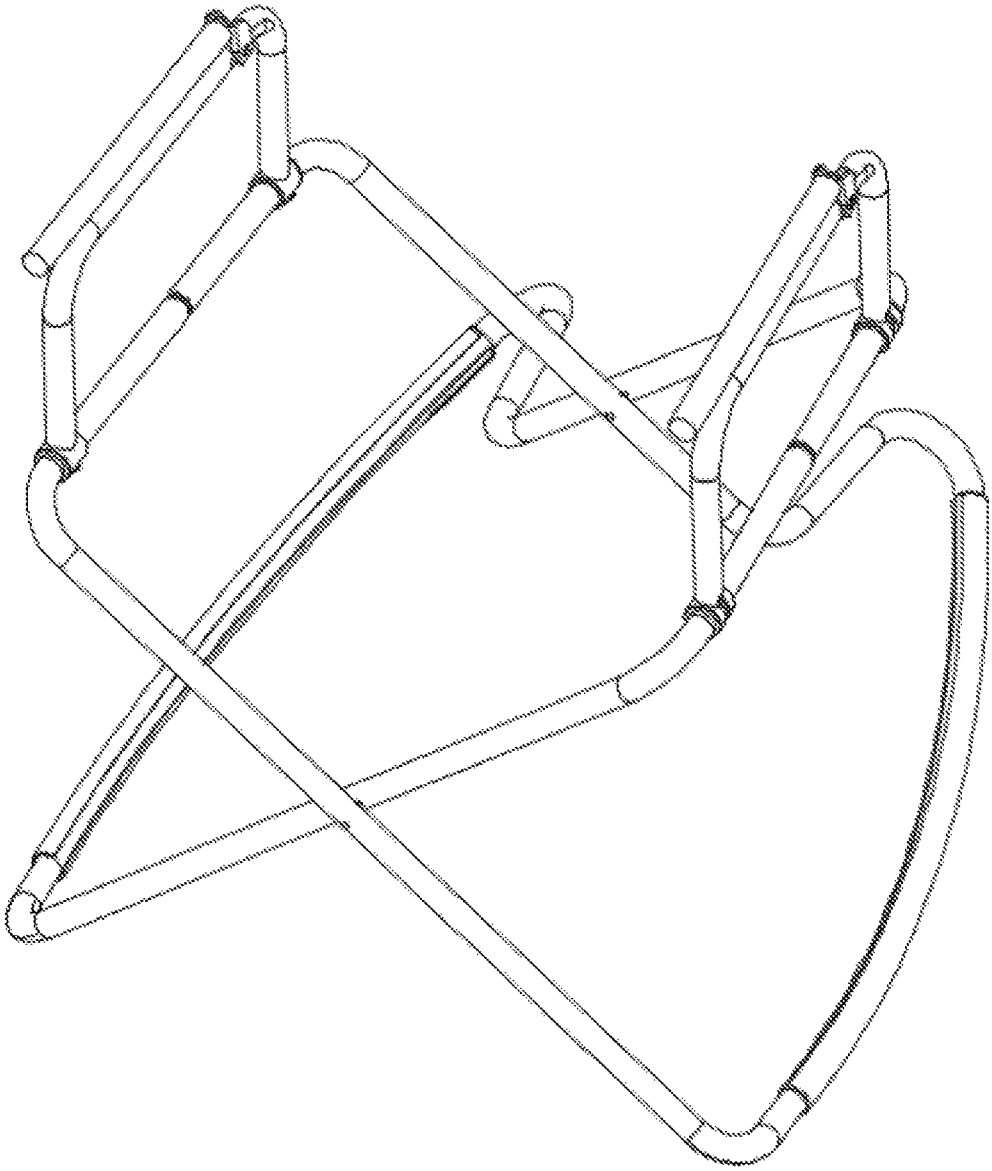
FIG. 13 is a schematic diagram of back tubes in a folded state
Figure 16:
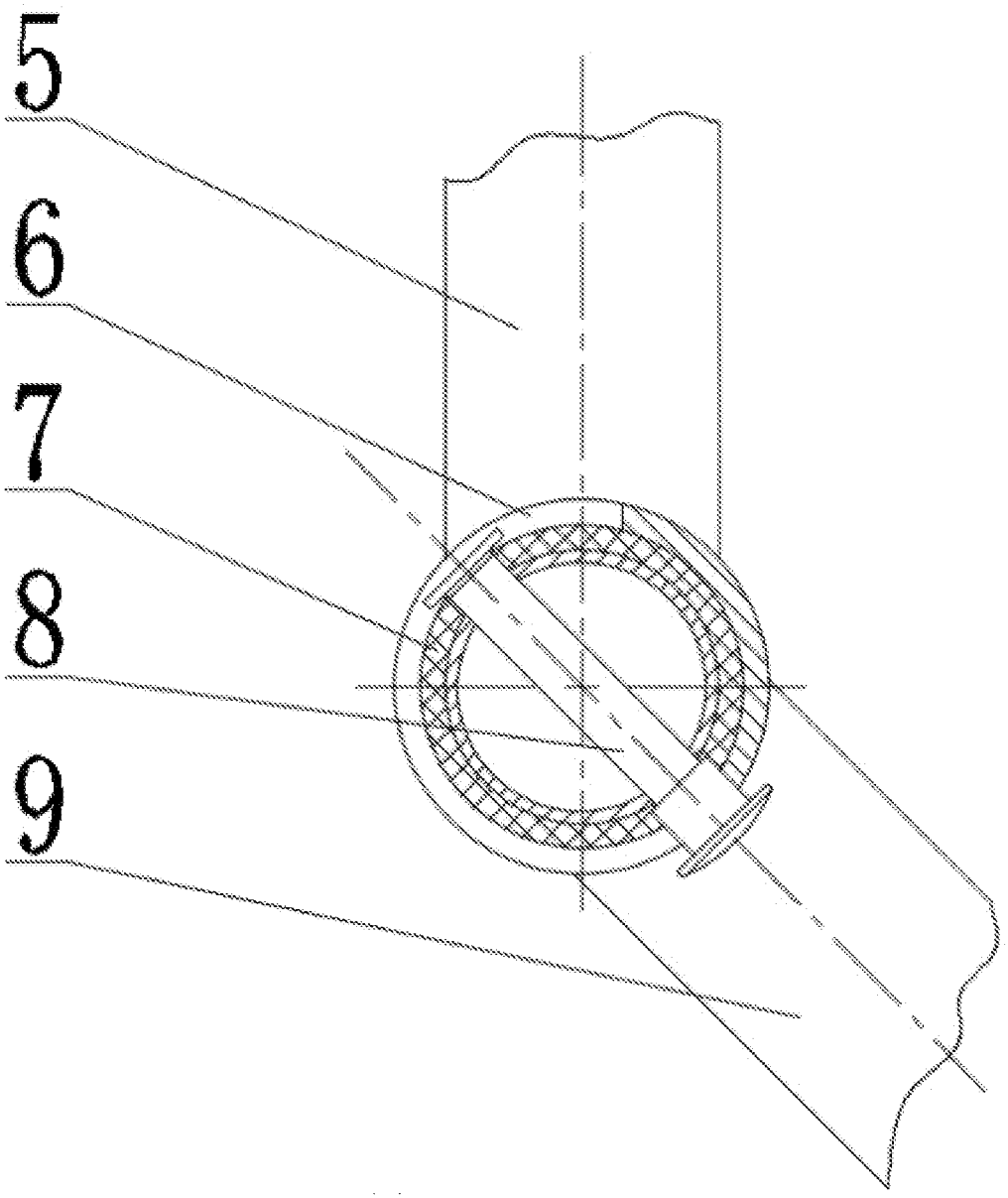
FIG. 16 is a schematic diagram of an armrest tube in an unfolded state
Figure 17:
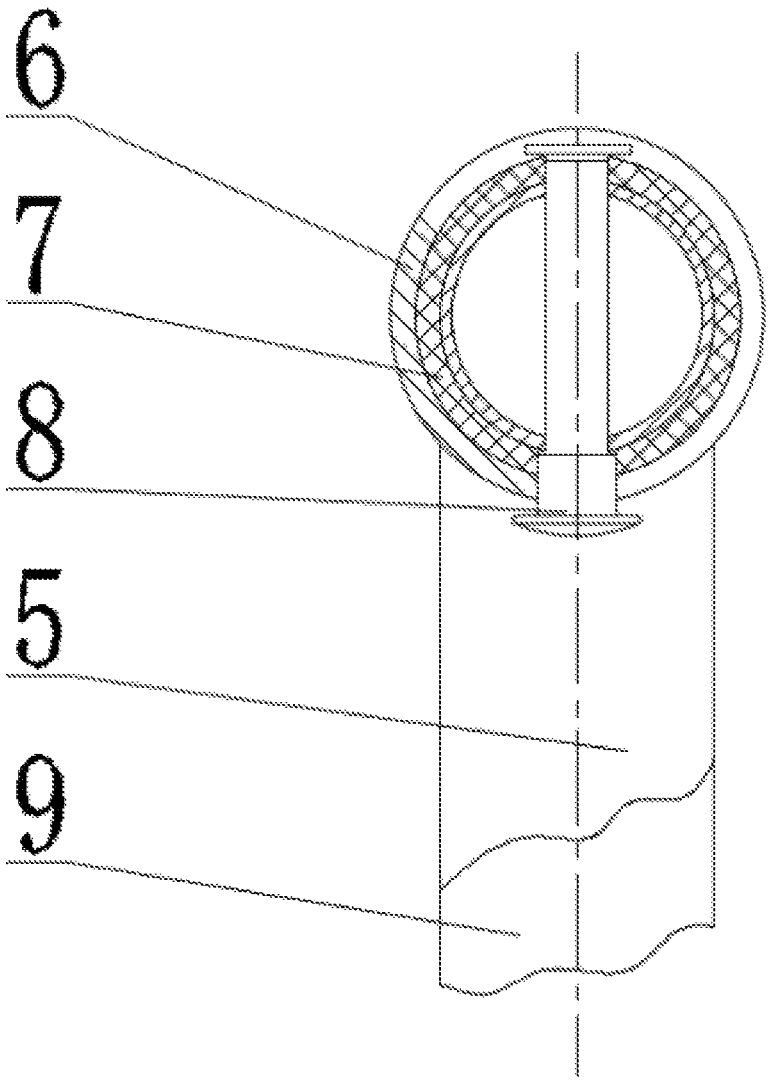
FIG. 17 is a schematic diagram of the armrest tube in a folded state
Figure 18:
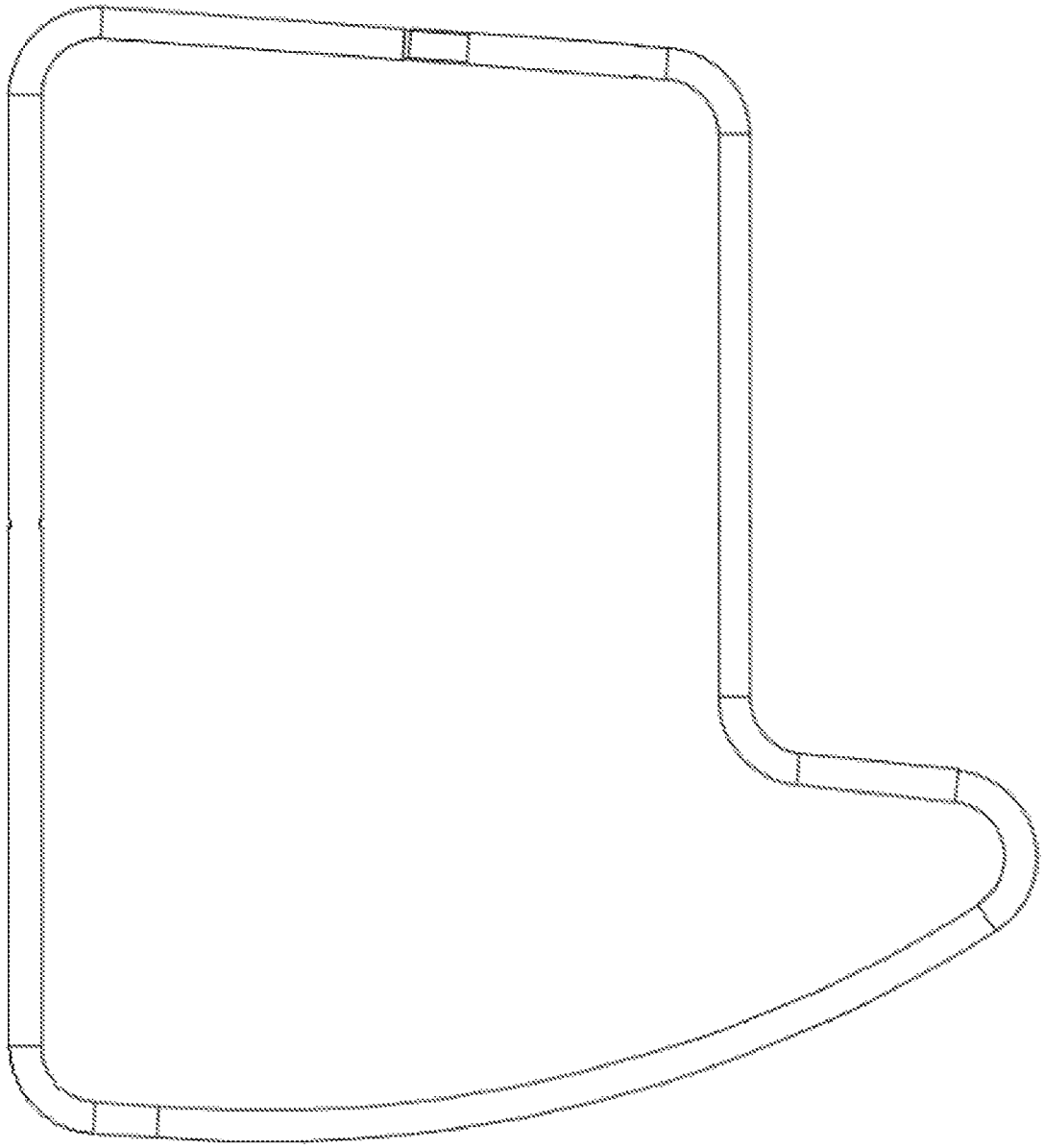
FIG. 18 is a schematic diagram of a bottom seat frame having a necked end not sleeved
Figure 19:
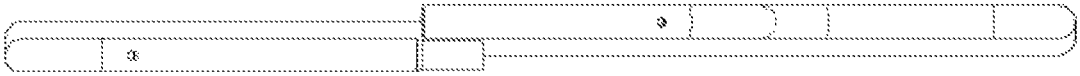
FIG. 19 is a top view of FIG. 18
Figure 20:
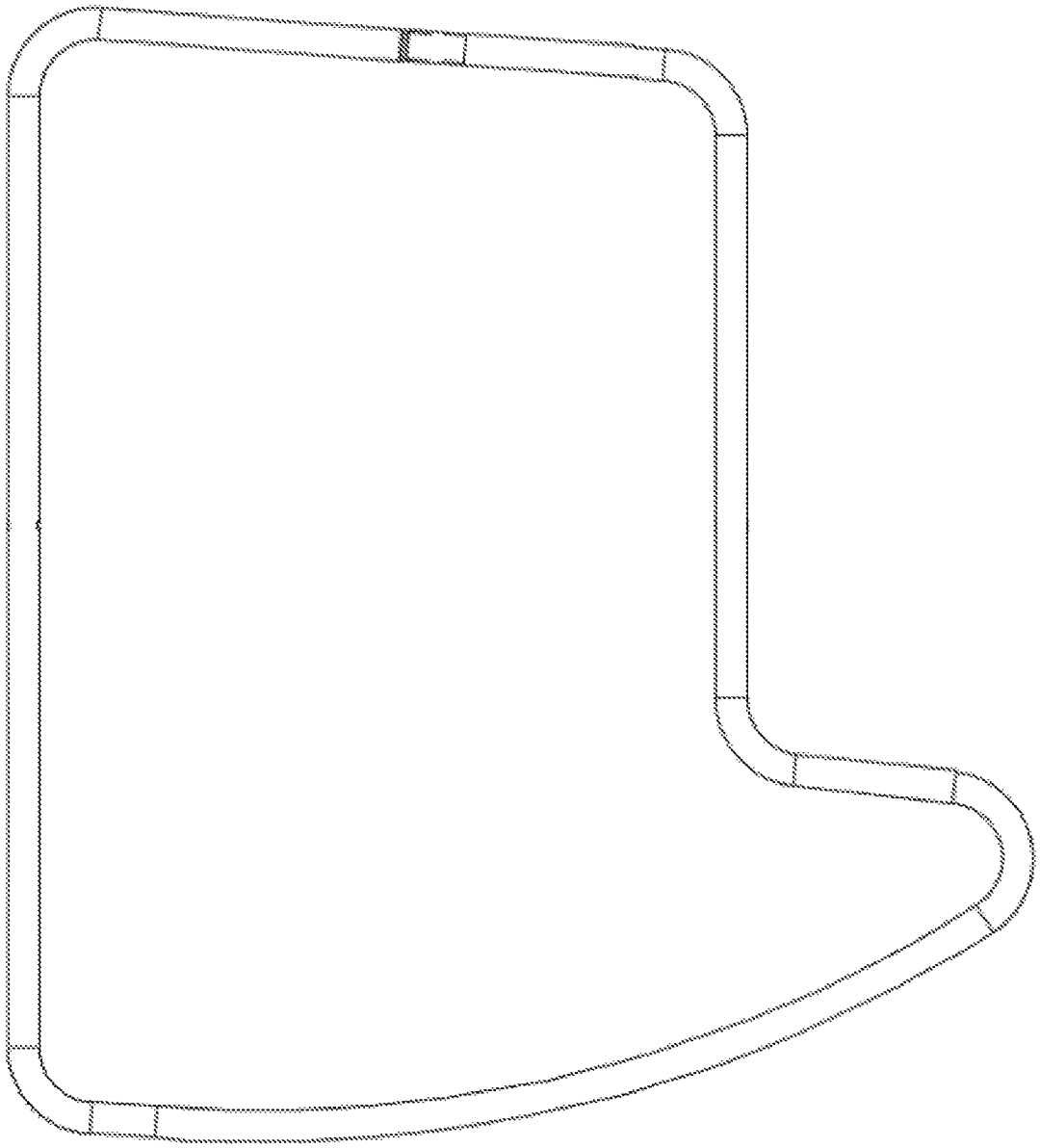
FIG. 20 is a schematic diagram of the bottom seat frame having a necked end sleeved
Figure 21:
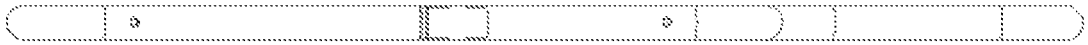
FIG. 21 is a top view of FIG. 20

The back tubes 3 and the turnover bases 4 which are welded together are riveted to the armrest tubes 5A and can axially rotate around the rivets (as shown in FIG. 13). Each base frame 9 is formed by a bent steel tube having a necked end (as shown in FIG. 18), and the necked end is inserted into a non-necked end to form a closed square frame (as shown in FIG. 19). The two base frames 9 assembled together in a cross manner, the two bushings 7 are disposed around the joint segment of each base frame 9 via two joints, and then the two armrest limit sleeves 6A welded to the armrest tube 5A are respectively disposed around the two bushings 7. The seat cushion of the chair cloth 1 wraps the base frames 9, and the necked ends are inserted into the non-necked ends to be covered with the cloth. The four step rivets 8 penetrate through annular limit grooves in the armrest limit sleeves 6A to fix the four bushings 7 to the base frames 9 (as shown in FIG. 16 and FIG. 17), so that the armrest limit sleeves 6A can drive the armrest tubes 5A welded to the armrest limit sleeves 6A to rotate simultaneously until the armrest tubes 5A make contact with the step rivets 8. The two base frames 9 are riveted together in an X shape in such a manner that the arc segments are located below the joint segments. The wear-resistant foot casings 10 are installed on the arc segments to reduce noises and paint scrapes (as shown in FIG. 11). The backrest of the chair cloth 1 is fixed to the back tubes 3 (as shown in FIG. 7).

Figure 7:
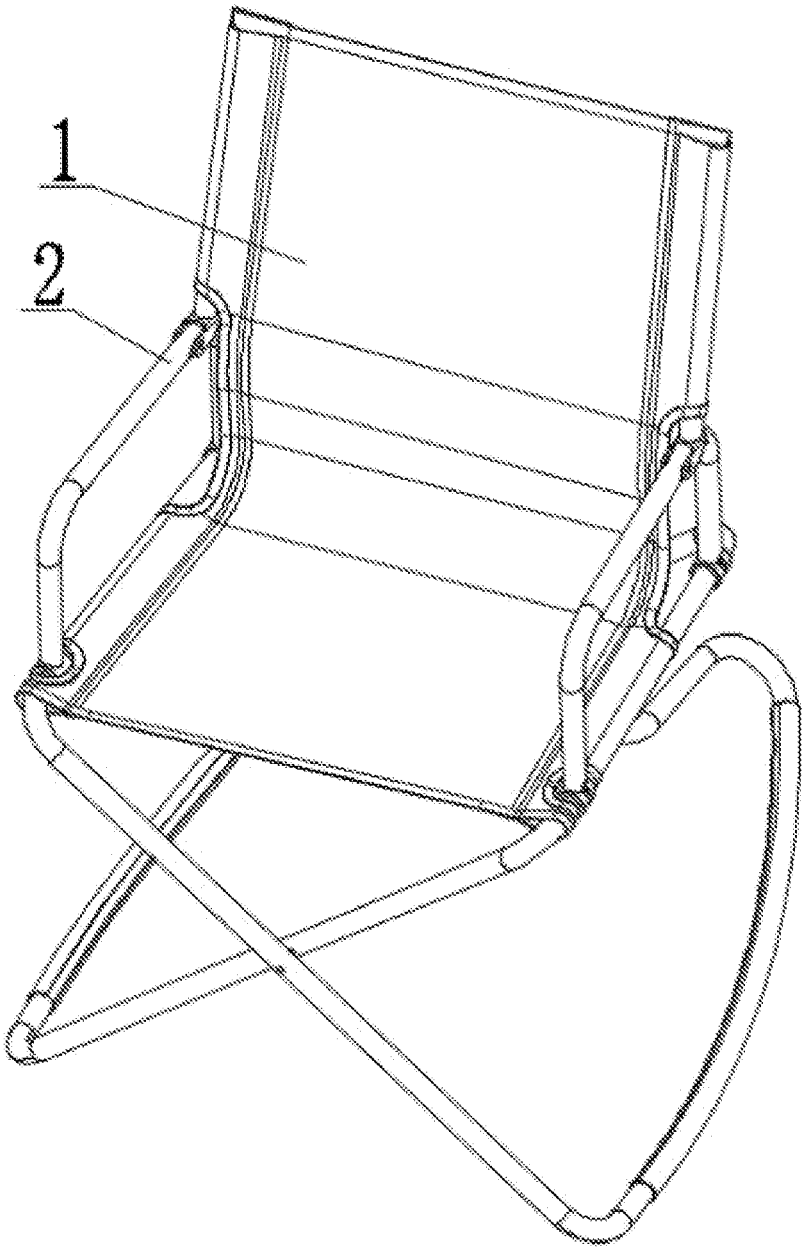
FIG. 7 is a schematic diagram of FIG. 1 in an unfolded state

The operating principle of the rocking chair in this embodiment is as follows:

When the chair needs to be folded: in an unfolded state (as shown in FIG. 7 and FIG. 11), the back tubes 3 are folded to be horizontal first (as shown in FIG. 13). Then the two crossed base frames 9 are folded (as shown in FIG. 14); and finally, the two armrest tubes 5A rotate outwards to drive the back tubes 3 on the armrest tubes 5A and the chair cloth 1 to rotate simultaneously until the armrest tubes make contact with each other after rotating by 180° (as shown in FIG. 8 and FIG. 15).

Figure 8:
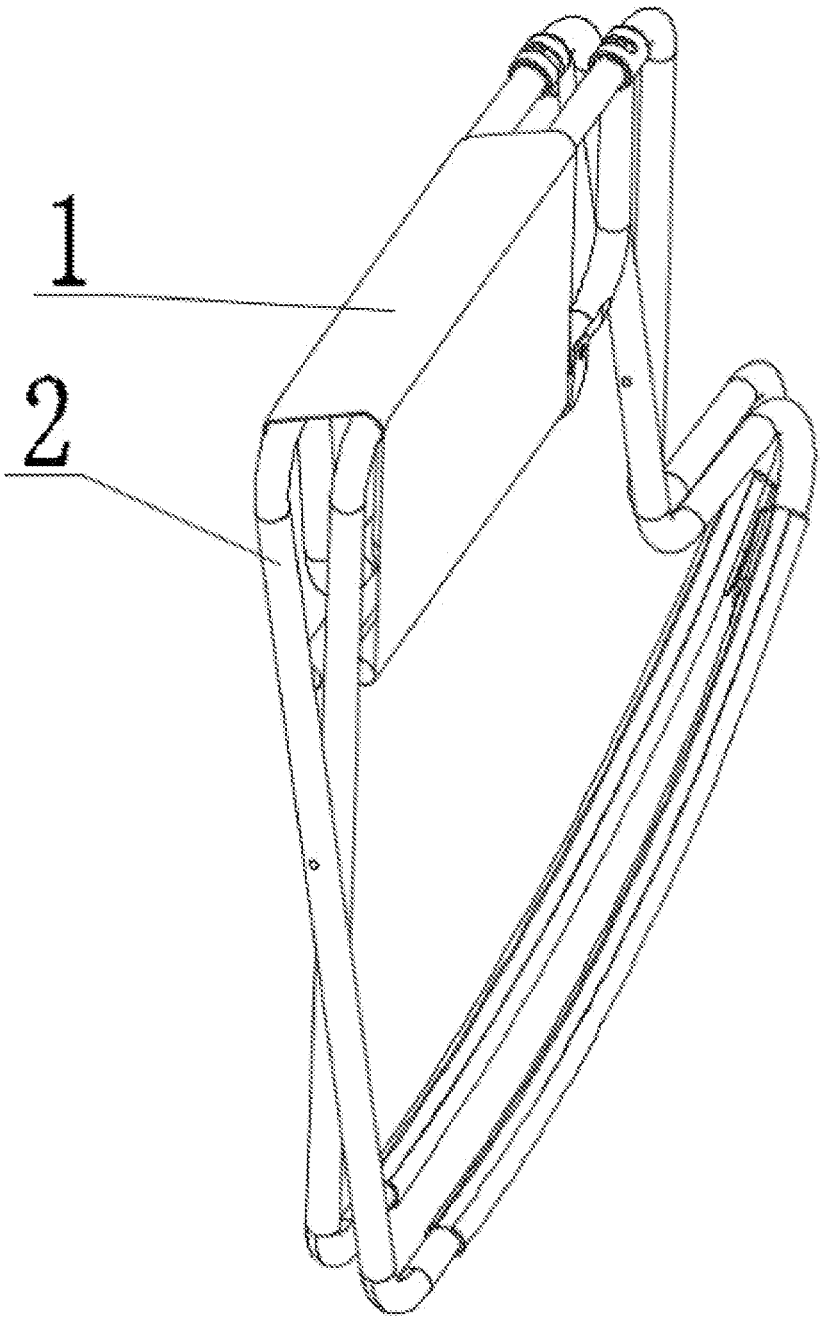
FIG. 8 is a schematic diagram of FIG. 1 in a folded state
Figure 9:
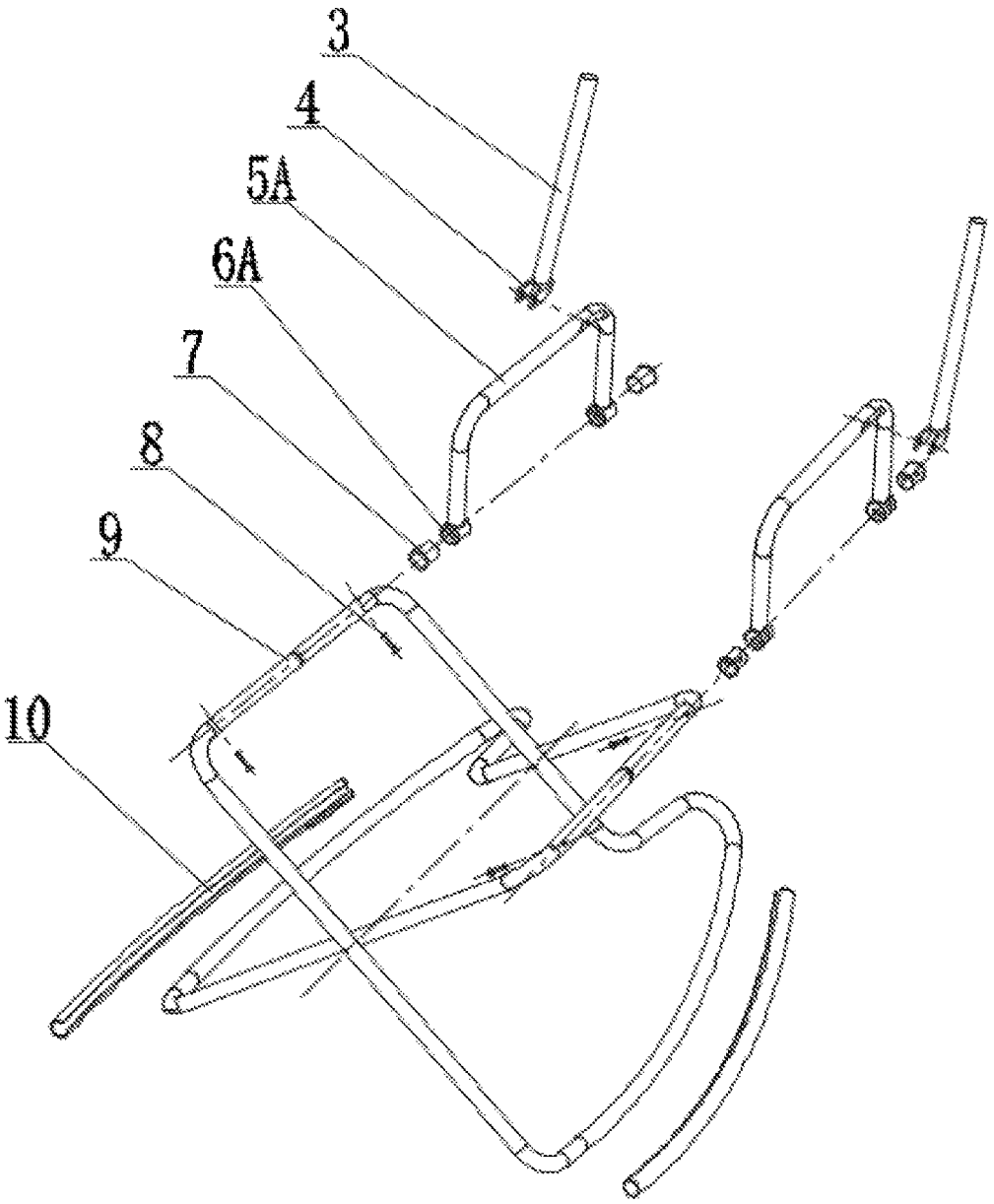
FIG. 9 is a structural exploded view of a first chair frame
Figure 14:
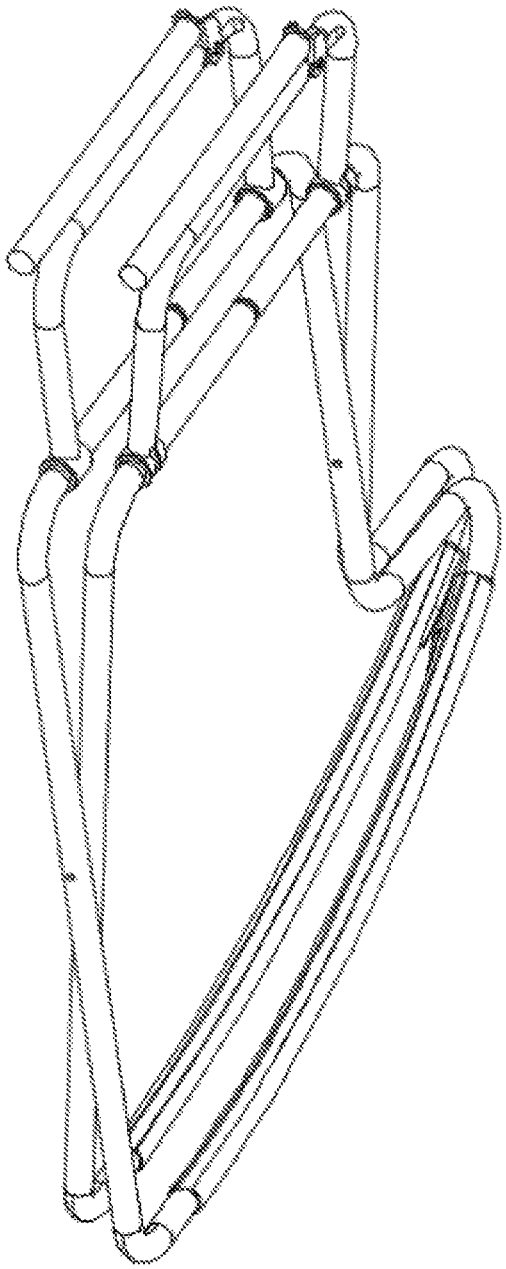
FIG. 14 is a schematic diagram of bottom seat frames in a folded state
Figure 15:
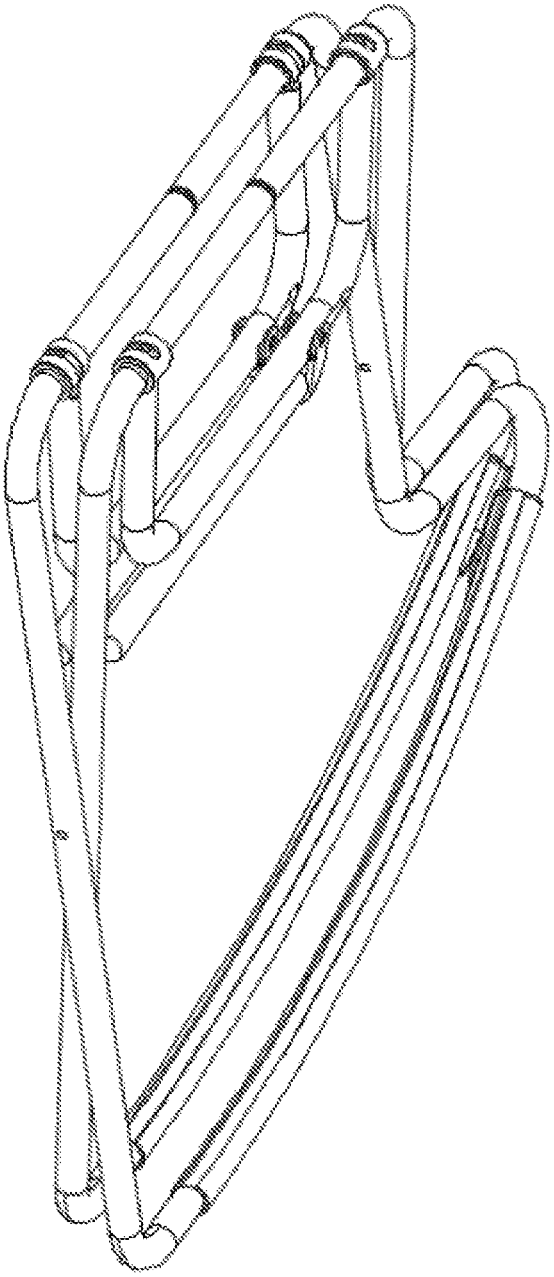
FIG. 15 is a schematic diagram of a chair frame in a folded state

When the chair needs to be unfolded: in a folded state (as shown in FIG. 8 and FIG. 15), the armrest tubes 5A are rotated upwards by 180° to drive the back tubes 3 on the armrest tubes 5A and parts, located on the back tubes 3, of the chair cloth 1 to rotate simultaneously upwards (as shown in FIG. 14). The two crossed base frames 9 are unfolded to tighten and unfold the seat cushion of the chair cloth 1 (as shown in FIG. 13). At this moment, the armrest limit sleeves 6A on the armrest tubes 5A exactly abut against the step rivets 8 to prevent the armrest tubes 5A from continuously rotating inwards, so that the armrest tubes 5A are perpendicular to the ground; and the back tubes 3 are turned upwards until the turnover bases 4 abut against the armrest tubes 5A and drive the backrest of the chair cloth 1 to be erected (as shown in FIG. 7 and FIG. 11).

Embodiment 2

Figure 10:
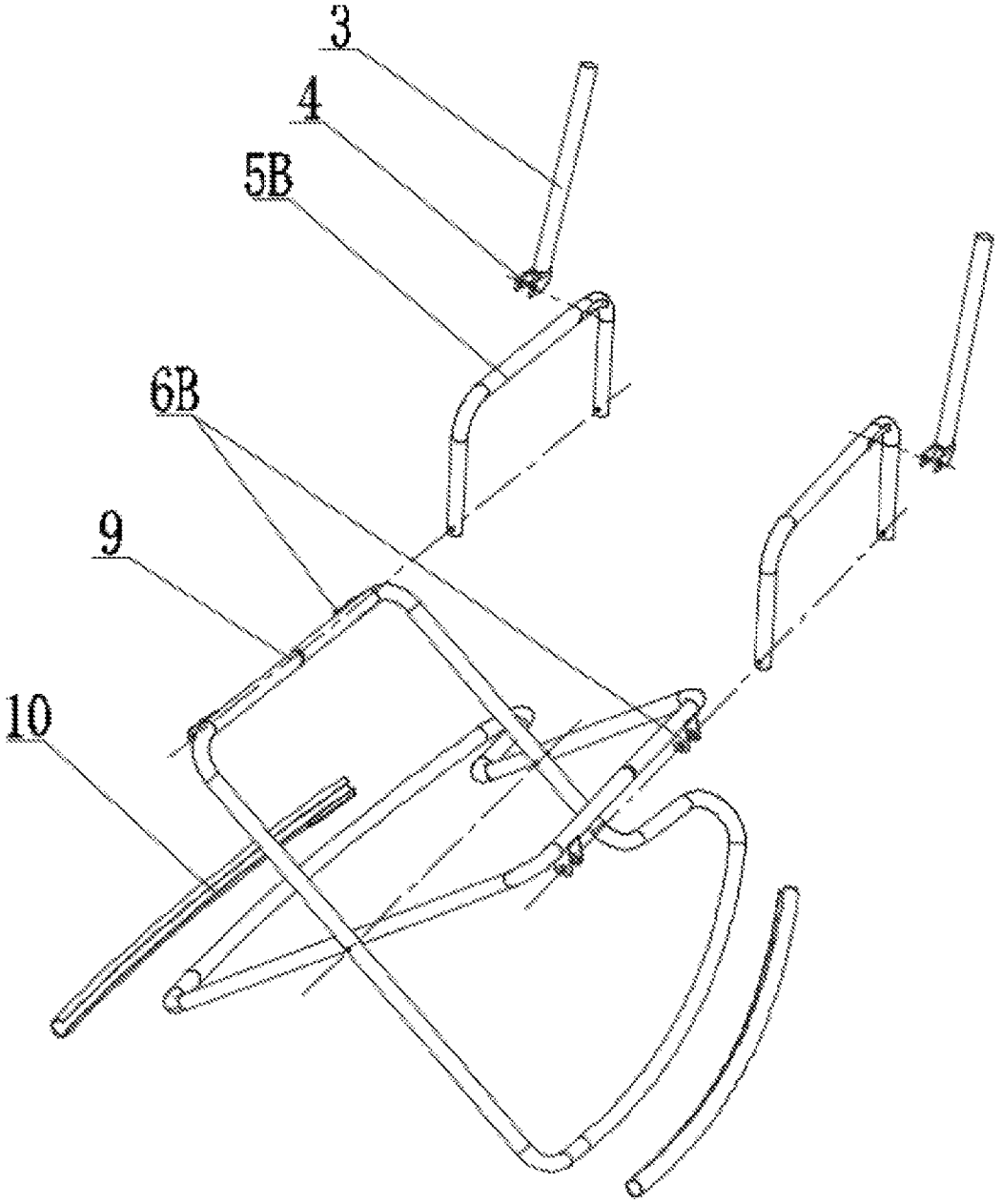
FIG. 10 is a structural exploded of a second chair frame
Figure 12:
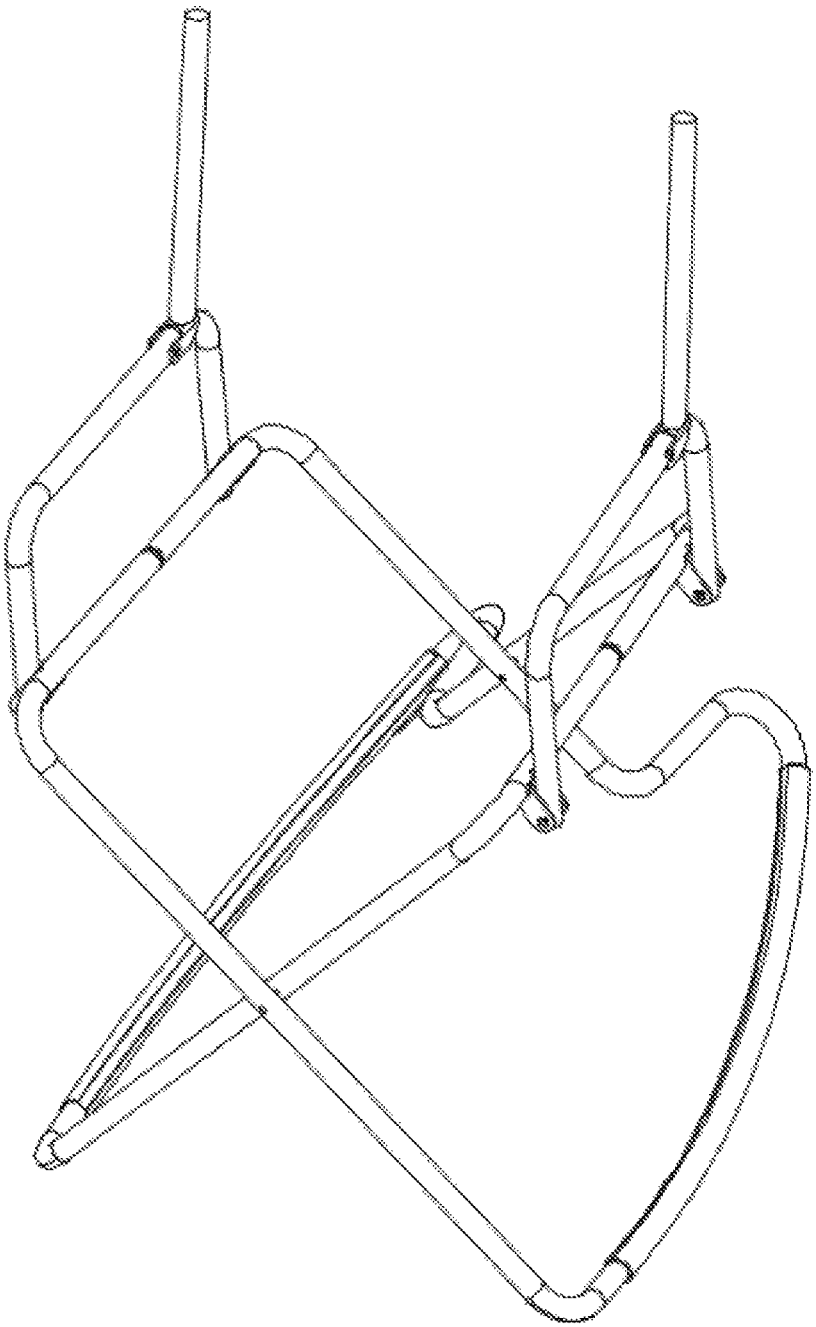
FIG. 12 is a structural view of the second chair frame in an unfolded state

Different from Embodiment 1, as shown in FIG. 10 and FIG. 12, this embodiment provides a chair frame of another structure, which includes two back tubes 3, two turnover bases 4, two armrest tubes 5B, four armrest fixing bases 6B, two base frames 9, and two wear-resistant foot casings 10, wherein the two back tubes 3 are respectively welded to the two turnover bases 4, which are respectively riveted to the two armrest tubes 5B and can axially rotate around the rivets. Each base frame 9 is formed by a bent steel tube having a necked end, and the necked end is inserted into a non-necked end to form a closed polygonal frame. The two base frames 9 are riveted together in an X shape, and the polygonal frames have lower arc segments and upper joint segments. The armrest fixing bases 6B are respectively arranged on two sides of the necked end and non-necked end of each joint segment, and the two armrest tubes 5B are respectively riveted to the armrest fixing bases 6B on the two joint segments. A seat cushion and a backrest of the chair cloth 1 are respectively installed on the joint segments of the base frames and the back tubes 3; and the two wear-resistant foot casings 10 are respectively arranged on the arc segments of the two base frames 9.

The armrest fixing bases 6B in this embodiment are preferably arranged on external sides of the joint segments of the base frames 9 and are each formed by two symmetrical fins, and installation holes used for riveting the armrest fixing bases 6B to the armrest tubes are formed in the middle of the fins.

The operating principle of the rocking chair in this embodiment is as follows:

When the chair needs to be folded: in an unfolded state (as shown in FIG. 7 and FIG. 12), the back tubes 3 are folded to be horizontal first (as shown in FIG. 13). Then the two crossed base frames 9 are folded (as shown in FIG. 14); and finally, the two armrest tubes 5B rotate outwards to drive the back tubes 3 on the armrest tubes 5B and the chair cloth 1 to rotate simultaneously until the armrest tubes make contact with each other after rotating by 180° (as shown in FIG. 8 and FIG. 15).

When the chair needs to be unfolded: in a folded state (as shown in FIG. 8 and FIG. 15), the armrest tubes 5B are rotated upwards by 180° to drive the back tubes 3 on the armrest tubes 5B and parts, located on the back tubes 3, of the chair cloth 1 to rotate simultaneously upwards (as shown in FIG. 14). The two crossed base frames 9 are unfolded to tighten and unfold the seat cushion of the chair cloth 1 (as shown in FIG. 13). At this moment, the lower ends of the armrest tubes 5B are dragged by the armrest fixing bases 6B, and the middles of the armrest fixing bases 6B abut against the base frames 9 to prevent the armrest tubes 5B from continuously rotating inwards, so that the armrest tubes 5B are perpendicular to the ground; and the back tubes 3 are turned upwards until the turnover bases 4 abut against the armrest tubes 5B and drive the backrest of the chair cloth 1 to be erected (as shown in FIG. 7 and FIG. 12).

The above embodiments are preferred ones of the utility model, and are not intended to limit the protection scope of the utility model. All transformations and improvements achieved by those skilled in the art on the basis of the design conception of the utility model should fall within the protection scope of the utility model. Particularly, various transformations and improvements of components and/or layouts of the combined structure of the subject matter can be made within the scope of this application, the accompanying drawings, and the claims. In addition to the transformations and improvements of the components and/or layouts, other purposes of the utility model will also be obvious for those skilled in the art.

What is claimed is:

1. A crosswise-folding rocking chair, comprising a chair frame and a chair cloth, wherein the chair frame includes two back tubes, two turnover bases, two armrest tubes, four armrest limit sleeves, four bushings, four step rivets, and two base frames, wherein the two back tubes are respectively welded to the two turnover bases, which are respectively riveted to the two armrest tubes and are able to axially rotate around the rivets;

each said base frame is formed by a bent steel tube having a necked end, and the necked end is inserted into a non-necked end to form a closed polygonal frame; and the two base frames are riveted together in an X shape, and the polygonal frames have lower arc segments and upper joint segments;

two said bushings are respectively disposed around two sides of each said joint segment through the necked end and the non-necked end, two said armrest limit sleeves welded to one said armrest tube are respectively disposed around the two bushings, two said step rivets penetrate through annular limit grooves in the two armrest limit sleeves to fix the two bushings to one said base frame, and the armrest limit sleeves drive the armrest tube welded to the armrest limit sleeves to rotate until the armrest tube makes contact with the rivets; and a seat cushion and a backrest of the chair cloth are respectively installed on the joint segments of the base frames and the back tubes.

2. The crosswise-folding rocking chair according to claim 1, wherein the crosswise-folding rocking chair further comprises two wear-resistant foot casings respectively arranged on the arc segments of the two base frames.

3. The crosswise-folding rocking chair according to claim 2, wherein wear-resistant foot casings having openings in a length direction and are disposed around the arc segments via the openings.

4. The crosswise-folding rocking chair according to claim 1, wherein two sides of the seat cushion of the chair cloth are respectively disposed around the joint segments of the two base frames, and the necked ends are inserted into the non-necked ends to be covered with the cloth on two sides of the seat cushion.

5. A crosswise-folding rocking chair, comprising a chair frame and a chair cloth, wherein the chair frame includes two back tubes, two turnover bases, two armrest tubes, four armrest fixing bases, and two base frames, wherein the two back tubes are respectively welded to the two turnover bases, which are respectively riveted to the two armrest tubes and are able to axially rotate around the rivets;

each said base frame is formed by a bent steel tube having a necked end, and the necked end is inserted into a non-necked end to form a closed polygonal frame; and the two base frames are riveted together in an X-shape, and the polygonal frames have lower arc segments and upper joint segments;

the armrest fixing bases are respectively arranged on two sides of the necked end and non-necked end of each said joint segment, and the two armrest tubes are respectively riveted to the armrest fixing bases on the two joint segments;

and a seat cushion and a backrest of the chair cloth are respectively installed on the joint segments of the base frames and the back tubes.

6. The crosswise-folding rocking chair according to claim 5, wherein the crosswise-folding rocking chair further comprises two wear-resistant foot casings respectively arranged on the arc segments of the two base frames.

7. The crosswise-folding rocking chair according to claim 6, wherein the wear-resistant foot casings have openings in a length direction and are disposed around the arc segments via the openings.

8. The crosswise-folding rocking chair according to claim 5, wherein two sides of the seat cushion of the chair cloth are respectively disposed around the joint segments of the two base frames, and the necked ends are inserted into the non-necked ends to be covered with the cloth on two sides of the seat cushion.

9. The crosswise-folding rocking chair according to claim 6, wherein two sides of the seat cushion of the chair cloth are respectively disposed around the joint segments of the two base frames, and the necked ends are inserted into the non-necked ends to be covered with the cloth on two sides of the seat cushion.

10. The crosswise-folding rocking chair according to claim 7, wherein two sides of the seat cushion of the chair cloth are respectively disposed around the joint segments of the two base frames, and the necked ends are inserted into the non-necked ends to be covered with the cloth on two sides of the seat cushion.

11. The crosswise-folding rocking chair according to claim 2, wherein two sides of the seat cushion of the chair cloth are respectively disposed around the joint segments of the two base frames, and the necked ends are inserted into the non-necked ends to be covered with the cloth on two sides of the seat cushion.

12. The crosswise-folding rocking chair according to claim 3, wherein two sides of the seat cushion of the chair cloth are respectively disposed around the joint segments of the two base frames, and the necked ends are inserted into the non-necked ends to be covered with the cloth on two sides of the seat cushion.

* * * * *